United States Patent [19]

Wigley

[11] Patent Number: 4,909,696

[45] Date of Patent: Mar. 20, 1990

[54] METHOD AND APPARATUS FOR LOADING A PRODUCT IN AN ENCLOSED BOX

[76] Inventor: Freddy J. Wigley, 712 N. Birch, Ponca City, Okla. 74601

[21] Appl. No.: 333,012

[22] Filed: Apr. 4, 1989

[51] Int. Cl.[4] ..... B65G 1/00

[52] U.S. Cl. ..... 414/287; 414/786; 414/392; 414/495; 414/180; 414/608; 62/DIG. 13; 432/241; 432/242; 53/127

[58] Field of Search ..... 62/DIG. 13; 414/495, 414/608, 284, 286, 399, 391, 399, 288, 331, 267, 209, 287, 222, 154, 180, 181, 786, 277, 281; 432/241, 242; 53/235, 241, 127

[56] References Cited

U.S. PATENT DOCUMENTS

| | | | |
|---|---|---|---|
| 2,516,786 | 7/1950 | Miller et al. | 432/241 X |
| 2,620,932 | 12/1952 | Alpine | 414/180 |
| 3,298,546 | 1/1967 | Jones | 432/242 X |
| 3,514,969 | 6/1970 | Harza | 53/127 X |
| 3,834,865 | 9/1974 | Lee | 432/241 |
| 3,958,701 | 5/1976 | Vatagai et al. | 414/392 X |
| 4,394,195 | 7/1983 | Ried et al. | 62/DIG. 13 X |
| 4,459,078 | 7/1984 | Chiantella et al. | 414/495 X |

FOREIGN PATENT DOCUMENTS

| | | | |
|---|---|---|---|
| 543864 | 1/1956 | Belgium | 414/495 |

*Primary Examiner*—Frank E. Werner
*Attorney, Agent, or Firm*—William J. Miller

[57] ABSTRACT

A method and apparatus for loading a refrigerator box which has a door along one side and insulation in all of the surfaces of the box including the bottom. The invention specifically relates to devices for loading the box using a pallet loaded with prepackaged material such as ice. The insulation in the bottom of the box is divided into three parts; the insulation along one side, the insulation along the opposite side and then the center insulation portion.

The method is accomplished by removing the center insulated portion and rolling a pallet loaded with prepackaged material into the refrigerated box using an ordinary transportation vehicle such as a lift cart. Once the vehicle has moved the pallet of prepackaged material into the refrigerated ice box or container, the transportation device is then lowered so that the pallet will settle onto the pieces of insulation on each side of the box. The transportation device is then removed and a piece of insulation is inserted under the pallet. The insulation extends over to and touches both pieces of insulation on each side of the box, thus, fully insulating the bottom of the box. The door is then secured in the usual manner.

8 Claims, 1 Drawing Sheet

METHOD AND APPARATUS FOR LOADING A PRODUCT IN AN ENCLOSED BOX

DESCRIPTION OF THE PRIOR ART

Various types of dispensing apparatus have been utilized for the sale of ice, for example. Such dispensing apparatus usually encompasses a single door which can be opened and the ice bags are then hand loaded into the box by stacking the new ice on top of the ice already existing in the box until the box is full. Such procedure takes an extended period of time if the box contains, for example, 300 or 400 bags of ice. The prior art procedure further suffers from the old ice at the bottom always remaining on the bottom and never being sold which will gradually cause deterioration of the ice so that it will eventually not become sellable.

Some boxes are built with access doors in the side of the box so that the box can be more easily hand loaded. All of these boxes have a thick layer of insulation in the bottom of the box to prevent the cold air from causing condensation of the liquid in the air from condensing at the bottom of the box and causing a problem for the box owner.

The basic problem with all of the above boxes is that they can not accommodate prepackaged ice, preloaded on a pallet, for example. The ice is then loaded on a pallet then the ice must be unloaded by hand into the box.

BRIEF DESCRIPTION OF THE INVENTION

This invention provides a means for loading a box in an extremely quick manner and provides for circulation of the old ice to the top of the ice stack so that it will be first used. The ice will then not become damaged or degraded through a lengthy storage, but will be sold within a reasonable time unlike the devices utilized in the prior art.

The above is accomplished by modifying the door in the side of the box or the front of the box so that it opens completely to the bottom of the box and removing the insulation that is provided with the box. Two metal covered insulation strips are then inserted along the sides of the box adjacent the door. These strips are wide and long enough to support a pallet. The space between the two parallel strips of insulation is filled with a third unit of insulation which is removable. Both the strips of insulation and the removable insulation are metal covered and filled with expanded foam, for example, to provide adequate insulation.

To place new ice in a refrigerated box, the door will be opened and the center portion of the insulation removed. A transportation device, either motorized or hand operated will then remove from a truck a pallet which has been loaded with ice bags. On each pallet several hundred ice bags will be stacked. Such loaded pallets can weigh as much as 2,000 pounds. Once the pallet is picked up by the loading apparatus, the pallet is transported to the box and slowly moved into the box. Once inside the box, the transporting apparatus lowers the pallet onto the insulation strips on each side of the box. The loading device is then moved out of the box and the center portion of the insulation is replaced in the box, thus, completing the total insulation for the bottom of the box. The door is then secured.

If the box has been previously used and has some ice remaining, once the door is opened and the center portion of the insulation removed, the transportation device will be inserted and jacked to lift the pallet off of the insulation strips on each side of the box and the entire pallet removed from the box. The transportation device will then lower the used pallet and ice to the floor and be reinserted into a new pallet of ice which is then jacked up so that it can be moved on the wheels of the transportation device and wheeled into the box. The transportation device then lowers the new pallet of ice onto the strips of insulation on each side of the wall and the transportation device is then removed from the box. The ice on the old pallet may then be stacked on the new ice already in the box, thus, causing the customer to utilize the old ice before removing the new ice from the box. The door is then closed and the apparatus is ready for use. Access to the interior of the box can be had through a separate access mounted in the loading door or mounted in another wall of the box.

The main feature of the invention is the ability to move a heavy pallet loaded with prepackaged ice or other material into a box having to hand transfer the material into the box by hand.

BRIEF DESCRIPTION OF THE FIGURES

Referring to the drawing

DETAILED DESCRIPTION OF THE FIGURES

Figures 1, 2:
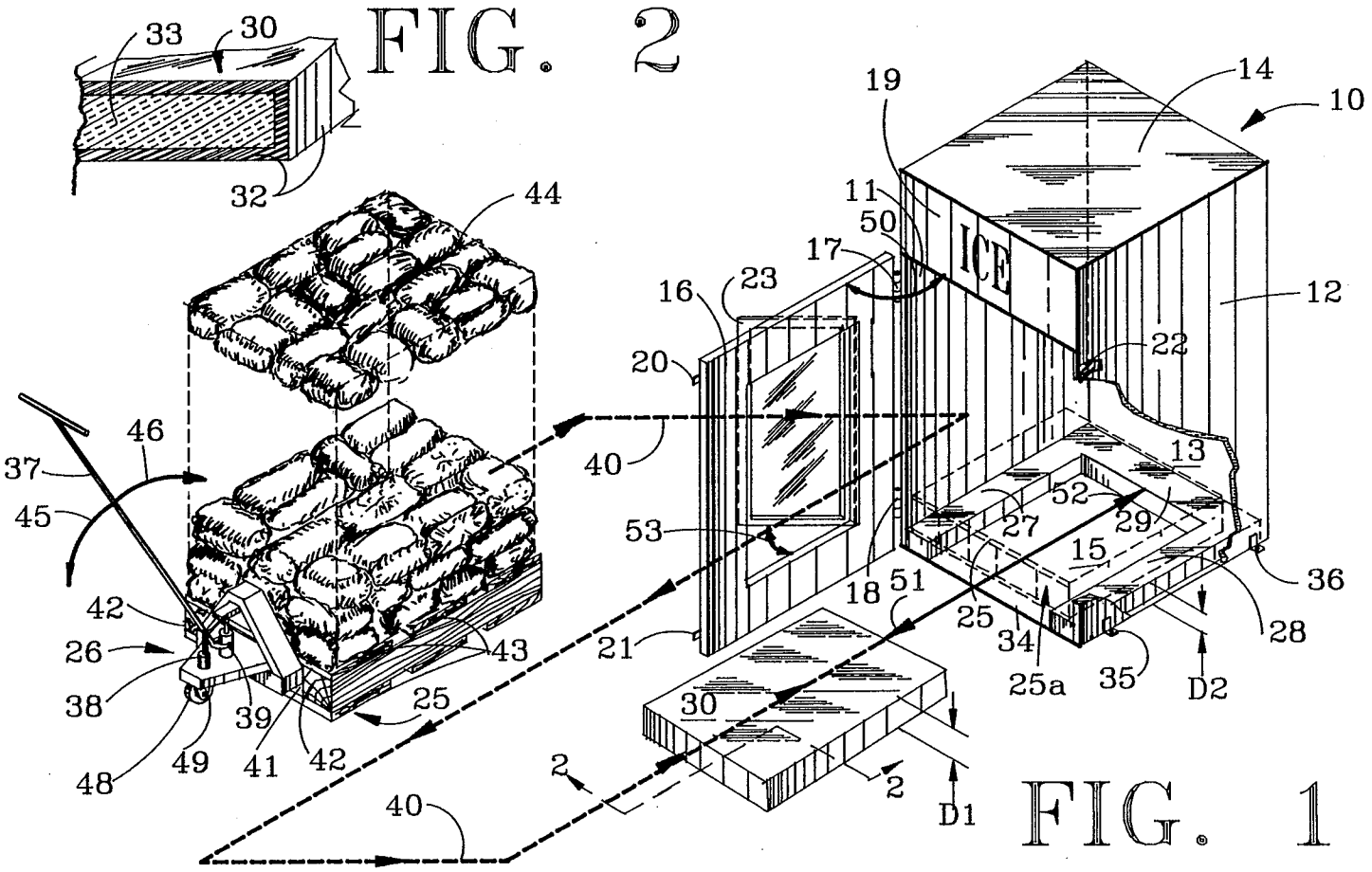
FIG. 1 illustrates the modified box, the pallet and handling apparatus used to move the pallet, and the method for moving the pallet and removing and installing the center portion of insulation; and, FIG. 2 is a cross-section of a portion of the insulation illustrated in FIG. 1.

Referring to all of the FIGURES, but in particular to FIG. 1, a refrigerated box generally referred to by arrow 10 has oppositely facing sides 11 and 12 and a back 13. Box 10 also includes a top 14 and a bottom 15. Box 10 has a door 16 hinged at 17 and 18 to side 11 of box 10.

Box 10 obviously requires refrigeration equipment. Refrigeration equipment is normally located in the space behind the part of the box labeled "ICE"; that is, the upper portion of box 10. However, the refrigeration equipment can be along side the box, in a building adjacent to the box, outside or any other suitable location.

Door 16 has latches 20 and 21 which are connected to a latch 22 for latch 20. The latch used to couple latch 21 is not illustrated, but is similar to latch 22. Latch 22 can be any ordinary latch such as a snap latch, a lock or any other suitable device for securely closing door 16 to front 19 of box 10. Contained in door 16 is an access glass door 23. Glass door 23 likewise has a release latch for access to the interior of the door to retrieve material inside of box 10, such latch is not illustrated, but is well known in the art and is like a refrigerator latch or any other suitable latch, as long as door 23 is kept closed during nonuse periods. The latch for door 23 could also comprise springs that would keep glass door 23 against door 16.

The improvement to the box disclosed is the ability to load box 10 with a pallet 25 by a mechanical moving apparatus or cart referred to by arrow 26. In order to provide a resting place for pallet 25, insulated portions 27 along side 11 and 28 along side 12 are provided. An additional portion 29 is provided along the end to ensure adequate insulation along bottom 15 of box 10. A central or center insulated portion 30 is configured to fill the space between insulated portions 27, 28 and 29.

Referring briefly to FIG. 2, the construction of all of the insulated portions 27 through 30 are shown. Basically said portions comprise an outer shell 32 of sheet metal along the ends, top, bottom and sides with insulation 33 inside the shell. Insulation 33 is generally a rigid insulation capable of taking the weight of pallet 25 and all loaded material thereon and could be expanded foam or cork insulation or some other form of rigid insulation. Bottom 15 of box 10 must have a vary thin lip or frontal entry portion 34. Bottom 15, for example, could be a piece of sheet metal or tie-rod merely to hold sides 11 and 12 from coming apart. In addition to an alternate form of anchoring sides 11 and 12 are "L" shape brackets 35 and 36 which are provided on each side of box 10 to anchor box 10 to a floor, for example. If brackets 35 and 36 are utilized, then a bottom 15 is not necessary, but may be provided to ease in shipping or handling the box when it is not anchored to the floor to keep insulation portion 30, for example, in box 10 and sides 11 and 12 from moving inward during the shipping or handling portion of box 10.

The important criterion of bottom 15 is that edge 34 be as small as possible so that transportation device 26 can be moved in the direction of arrow 40 such that when striking lip 34 an excessive amount of force will not be required to raise transportation device 26 over lip 34. Transportation device 26 is well known in the art and provides a pair of prongs 41 which move between support wooden portions 42 of which there are normally three. Only two of wooden support portions 42 are shown, the third is hidden by mechanical moving device 26. Transportation device 26 also includes a pair of wheels at the end of prongs 41 which are not shown. The wheels are lowered when transportation device 26 is jacked up by using handle 37 which is coupled a piston 38 and a hydraulic cylinder 39. The pumping action commences when handle 37 is brought down in the direction of arrow 45 and then reversed in the direction of arrow 46. Transportation device 26, in addition to the front wheels which have been described, has a rear wheel or wheels 48 used to move transportation device 26. Wheels 48 are pivotal on a caster 49.

The pallet is of normal construction having wood boards 43 above and below wooden supports 42 in order for material to be placed thereon and in order to maintain an integral pallet unit. When material is being placed into box 10, it is prepackaged at the warehouse, covered with plastic and insulation and transported by truck to the site to be utilized. The packaged material 44 in the example illustrated is bags of ice. If the ice weights eight pounds and a pallet contained 200 to 208 bags, then the weight of the pallet will 1,664 pounds. It is obvious that with this much weight, that the maneuvering of the transportation device over a substantial lip 34 would be impossible for the average person.

OPERATION

The operation will differ somewhat depending upon whether or not box 10 has already been utilized for storage of packaged material such as ice 44, or whether or not it is the first time use.

If it is the first time use, then door 16 will be opened in the direction of arrow 50 by unlatching latches 22 and swinging door 16 outwardly. With door 16 adequately open, then center portion 30 is removed in the direction of arrow 51 and set aside. Pallet 25 which is on the truck in storage is then moved by inserting transportation device prongs 41 between wooden supports 42 and then handle 37 is actuated up and down in the direction of arrow 45 and 46 until prongs 41 have lifted pallet 25 off the ground so that it can be easily moved. The front wheels which are not shown, will lower and touch the ground and then provide mobility between the front wheels and rear wheel 48. Handle 37 is then used to move pallet 25 by pulling it, for example, in the direction of arrow 40 until it is positioned in front of box 10. Pallet 25 is then carefully pushed into box 10 all the way so that the front of pallet 25 clears edge 34 to the position illustrated by the dotted lines of pallet **25*a*, whereupon a valve is thrown (not shown) and transportation device 25 settles until it can be pulled out from pallet 25**.

Center portion 30 is then inserted under pallet 25 in the direction of arrow 52 until it is fully into box 10 and under pallet 25. Door 16 is then moved to a closed position as illustrated by arrow 50 and latches 20 and 21 are secured with latch portions 22. Access to the interior can then be had by opening glass door 23 in the direction of arrow 53 whereupon the products, such as ice 44 can be removed and glass door 23 reclosed as previously described.

In case a pallet was already in position as illustrated by **25*a*, then door 16 is opened by unlatching latches 20 and 22 along with 21 and its mating latch and door 16 swung fully opened as illustrated in FIG. 1. Center portion 30 will then be removed by sliding it out from under pallet 25*a*. A transportation device 26 will then be shoved into pallet 25*a* and jacked up until pallet 25*a* rises above the upper surface of insulated portions 27 and 28 whereupon the pallet is removed from box 10 and a new pallet, as previously described, is reinserted. Any ice remaining on the old pallet can then be hand transferred to the new pallet and door 16** closed and latched as previously described. It is obvious that if the old ice is not desired to be transferred to the new pallet of ice, then it can be returned to the factory.

CONCLUSIONS

One of the biggest problems with the handling of ice has been the intensive labor required to transfer 100 to 200 bags of ice or more from a truck by hand to an ice storage container. This invention provides for an easy and rapid method of transferring the ice from a prepackaged container in the truck which is used to transfer the ice from the factory to the location where the ice is used, and then for moving the ice from the truck to the ice storage machine with virtually no effort aside from that physically required to move the pallet using the transportation device. It would have been impossible to move the transportation device into box 10 if any insulation were in bottom 15 of box 10. This invention provides an unique solution because without the insulation in box 10, condensation would form along bottom 15 of box 10 and run out onto the floor making the location around the ice machine hazardous to person, causing them to perhaps slip and fall and resulting in liability to the person owning the ice machine and dispensing the ice, such as and for example, a grocery store or convenience store.

This invention will substantially reduce the cost of maintaining and filling ice or refrigeration boxes and thus, ultimately reduce the costs of ice to the customer.

It is obvious, of course, that other modifications can be made and still be well within the spirit and scope of this invention as described in the specification and appended claims.

What I claim is:

1. A refrigerated storage box having first and second opposite facing insulated sides and a third insulated side attached along its edges to an edge of said first and second sides, respectively, an insulated top attached along its edges to said first and second oppositely facing insulated sides and said third insulated side, fourth side means having a bottom and pivotally attached along one side to an edge of said first insulated side and secured to an edge of said second insulated side, an improved box for handling the insertion of a heavily loaded pallet comprising:

(a) door means formed in said fourth side means extending to the bottom of said fourth side means; and (b) floor means mounted on said bottom comprising a first and second insulated portion and a center insulated portion, said first insulated portion extends along said first insulated side, and abuts said third side and said door means said second insulated portion extends along said second insulated side and abuts said third side and said door means, said center insulated portion is dimensioned to fill the space between said first and second insulated portions and wherein said space between said first and second insulated portions is sufficient to accommodate a transportation means when said center mounted portion is removed, whereby when said door means is opened and said center insulated portion is removed, said transportation means carrying said heavily loaded pallet can move on said bottom into said box and lower said pallet onto said first and second insulated portions, and when said transportation means is then removed after further lowering, said center insulated portion can be reinserted between said first and second insulated portions and said door closed thereby forming an insulated storage box.

2. Apparatus as claimed in claim 1 wherein said first and second insulated portions comprise a metal outer shell filled with insulation material.

3. Apparatus as claimed in claim 2 wherein said center insulated portion comprises a metal top, bottom and edges to form a shell and wherein said shell is filled with insulation material.

4. Apparatus as claimed in claim 2 wherein said first insulated portion and said second insulated portions are joined along said third insulated side with a third insulated portion and wherein said center insulated portion extends from said door means to said third insulated portion.

5. Apparatus as claimed in claim 1 wherein said center insulated portion comprises a metal top, bottom and edges to form a shell and wherein said shell is filled with insulation material.

6. Apparatus as claimed in claim 5 wherein said center insulated portion has a height less than the height of said first and second insulated portion whereby said center portion can be removed or inserted easily when said pallet is resting on said first and second insulated portion.

7. Apparatus as claimed in claim 1 wherein said center insulated portion has a height less than the height of said first and second insulated portions, whereby said center portion can be removed or inserted easily when said pallet is resting on said first and second insulated portion.

8. An improved method of loading a pre-packaged material into a refrigerated box having an insulated door along one side and insulation on all of the surfaces of said box including oppositely facing sides, a top, a rear side facing said door and a bottom of said box; said method comprising:

(a) loading said prepackaged material onto a pallet;

(b) forming said bottom insulation into a first portion along one side adjacent said door and extending to said rear side; a second portion along said remaining side adjacent said door and extending to said rear side; and forming a center portion filling the space between said first and second portions and extending between said door and said rear side;

(c) removing said center portion from said box;

(d) inserting a transportation means into said pallet and moving said pallet loaded with said prepackaged material along the uninsulated bottom into said box, said space between said first and second portions being wider than said transportation means, but less than the width of said pallet;

(e) lowering said pallet onto said first and second portions;

(f) removing by further lowering said transportation means; and (g) reinserting said center portion, whereby said bottom is again fully inserted and said door is then closed to form an insulated box.

* * * * *